US008320807B2

(12) United States Patent
Onodera et al.

(10) Patent No.: US 8,320,807 B2
(45) Date of Patent: Nov. 27, 2012

(54) IMAGE FORMING APPARATUS FOR FORMING AN IMAGE ON A SHEET AT A NIP PORTION FORMED BY ROTARY BODIES

(75) Inventors: Masahiro Onodera, Hino (JP); Junichi Hamada, Hachioji (JP); Hiroshi Funabiki, Uenohara (JP); Hidetoshi Katayanagi, Tokyo (JP)

(73) Assignee: Konica Minolta Business Technologies, Inc. (JP)

( * ) Notice: Subject to any disclaimer, the term of this patent is extended or adjusted under 35 U.S.C. 154(b) by 483 days.

(21) Appl. No.: 12/575,119

(22) Filed: Oct. 7, 2009

(65) Prior Publication Data

US 2010/0092218 A1 Apr. 15, 2010

(30) Foreign Application Priority Data

Oct. 10, 2008 (JP) ..... 2008-263623

(51) Int. Cl.
*G03G 15/20* (2006.01)

(52) U.S. Cl. ..... 399/323

(58) Field of Classification Search ..... 399/92, 399/322, 323, 398
See application file for complete search history.

(56) References Cited

U.S. PATENT DOCUMENTS

| | | | | |
|---|---|---|---|---|
| 3,981,085 | A * | 9/1976 | Franko | 399/323 |
| 2004/0120735 | A1* | 6/2004 | Baba et al. | 399/323 |
| 2007/0147912 | A1* | 6/2007 | Fujii | 399/323 |
| 2007/0206981 | A1* | 9/2007 | Amico et al. | 399/323 |
| 2008/0193176 | A1* | 8/2008 | Roof | 399/323 |

FOREIGN PATENT DOCUMENTS

| | | | |
|---|---|---|---|
| JP | 2004-212954 | A | 7/2004 |
| JP | 2006-113342 | A | 4/2006 |
| JP | 2008-102408 | * | 5/2008 |

* cited by examiner

*Primary Examiner* — Sandra Brase
(74) *Attorney, Agent, or Firm* — Cantor Colburn LLP

(57) ABSTRACT

An image forming apparatus includes: a first rotary body; a second rotary body provided to face the first rotary body, wherein the first rotary body and the second rotary body form a nip portion by coming in contact with each other to rotate, at which a sheet bearing a toner image is conveyed while being heated and pressed, thereby fixing the toner image onto the sheet; a first nozzle which blows air to a first air blowing position established on a circumferential surface of the first rotary body and on a side of an outlet of the nip portion; and a second nozzle which blows air to a second air blowing position established on a circumferential surface of the second rotary body and established downstream of the first air blowing position in a traveling direction of the sheet.

5 Claims, 7 Drawing Sheets

110

IMAGE FORMING APPARATUS FOR FORMING AN IMAGE ON A SHEET AT A NIP PORTION FORMED BY ROTARY BODIES

This application is based on Japanese Patent Application No. 2008-263623 filed on Oct. 10, 2008, which is incorporated hereinto by reference.

BACKGROUND OF THE INVENTION

The present invention relates to an image forming apparatus wherein a toner image is fixed on a sheet at a nip portion that is formed by rotary bodies which rotate while facing each other.

Many of image forming apparatuses of an electrophotographic technology type have a fixing section that fixes a toner image on a sheet by conveying the sheet that carries a toner image while pressurizing and heating it in a nip portion that is formed by rotary bodies which face each other to rotate, for example, by rollers or by a belt that is trained about plural rollers.

The fixing section constituted in this way sometimes has a so-called winding accident wherein toner on a sheet is melted by heating, and viscosity of the melted toner causes the sheet to stick to the rotary body for heating a toner image, and the sheet is not separated.

To avoid the troubles mentioned above, there is employed widely a technical measure to separate a sheet from a roller by causing a separation claw or a member for separation called a separation sheet to touch the roller.

However, the technology to separate a sheet from a roller by using a member for separation that is like one mentioned above sometimes generates a scratch on an image surface of a print, because it is a technical measure to cause an image surface of a sheet to touch the member for separation.

The scratch of this kind is a main cause to lower greatly a quality of an image where toner sticks to a certain entire area, representatively, a print on which a color image is formed.

Therefore, a technical measure to separate a sheet from a roller by blowing air against a leading edge of the sheet that has just passed through the nip portion is also employed widely, as a measure to separate a sheet from a roller without touching an image surface of the sheet sticking to the rotary body (for example, see Unexamined Japanese Patent Application Publication No. 2004-212954).

In general, a force for separating a sheet from a rotary body (first rotary body) is enhanced more when air to be blown is strengthened more. However, in this case, the sheet thus separated is pressed strongly against another rotary body (second rotary body) that is arranged to face the first rotary body, or is pressed strongly against a guide member provided to be close to the second rotary body.

The phenomenon of this kind makes separation of a sheet from the second roller to be difficult, or, strong touch between the guide member and the image having already been formed on the reverse side causes new occurrence of scratches on the image surface, resulting in a cause of an image quality decline, when images are formed on both sides of a sheet.

Further, for preventing occurrence of the aforesaid troubles, there is a suggestion to arrange air blowing devices to face the first rotary body and the second rotary body (For example, see Unexamined Japanese Patent Application Publication No. 2006-113342).

However, it was found out that behaviors of a leading edge of a sheet become unstable, and dangerousness for occurrence of jamming increases when doing nothing except blowing air against a leading edge of a sheet by arranging air blowing devices to face both of the first and second rotary bodies.

The invention has been achieved in view of the aforesaid circumstances, and its objective is to realize an image forming apparatus wherein nozzles each blowing air against a position established on a circumferential surface of each of the two rotary bodies which face each other to rotate are provided at positions corresponding to the aforesaid two rotary bodies, and timing of blowing air of each nozzle is controlled based on a position of an advancing sheet to separate a sheet from the two rotary bodies surely.

SUMMARY OF THE INVENTION

One aspect for achieving the aforesaid objective is as follows an image forming apparatus having a first rotary body, a second rotary body provided to face the first rotary body, wherein the first rotary body and the second rotary body form a nip portion by coming in contact with each other to rotate, at which a sheet bearing a toner image is conveyed while being heated and pressed, thereby fixing the toner image onto the sheet, a first nozzle which blows air to a first air blowing position established on a circumferential surface of the first rotary body and established on a side of an outlet of the nip portion, and a second nozzle which blows air to a second air blowing position established on a circumferential surface of the second rotary body and established downstream of the first air blowing position in a traveling direction of the sheet.

BRIEF DESCRIPTION OF THE DRAWINGS

Each of FIG. 4A

DETAILED DESCRIPTION OF THE PREFERRED EMBODIMENT

As in the following, there will be explained an embodiment of the invention to which, however, the invention is not limited.

Figure 1:
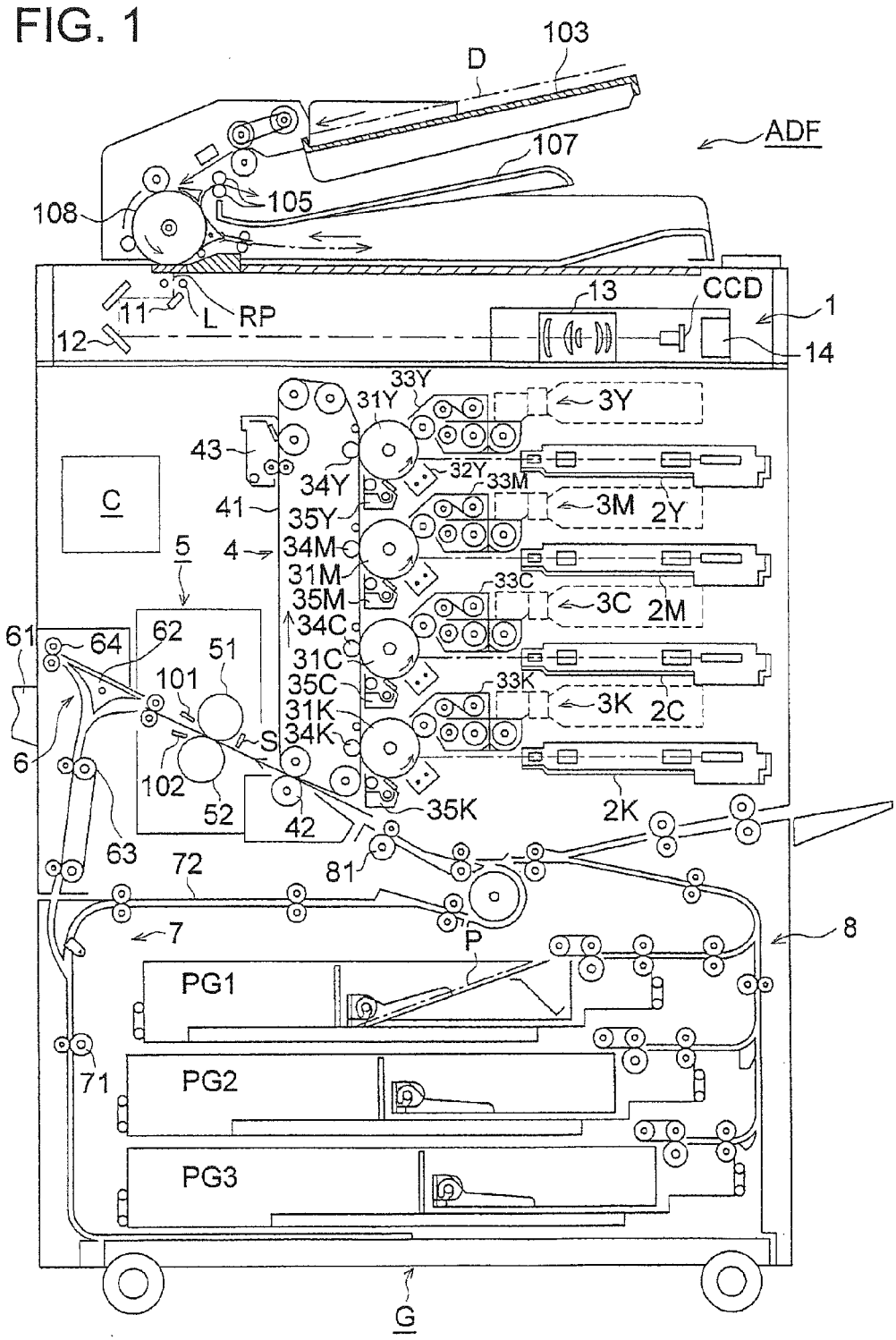
FIG. 1 is a conceptual diagram of an image forming apparatus.

FIG. 1 is a conceptual diagram of image forming apparatus G.

Color image forming apparatus G exemplified in FIG. 1 is one that is called a tandem type color image forming apparatus for forming a full-color image wherein a plurality of photoconductors 31Y, 31M, 31C and 31K are arranged lengthwise to be side by side to face one intermediate transfer belt 41.

The color image forming apparatus G is equipped, on its upper portion, with automatic document feeder ADF.

Documents D placed on document placing table 103 of the automatic document feeder ADF are separated to be a sheet that is fed out to a document conveyance path to be conveyed by conveyance drum 108.

An image of document D that is in transit is read by document reading section 1 at document image reading position RP. Document D that has been terminated in terms of reading is ejected out to document ejection stand 107 by plural conveyance guides and by document ejection roller 105.

The image forming apparatus G is composed of document reading section 1, exposure sections 2Y, 2M, 2C and 2K, image forming sections 3Y, 3M, 3C and 3K, intermediate transfer section 4, fixing section 5, reversing and ejecting section 6, re-feeding section 7, feeding section 8, and of controller C, which are housed in one casing.

The document reading section 1 illuminates an image of a document with lamp L at document reading position RP, and it guides a rejected light with first mirror unit 11, second mirror unit 12 and with lens 13, to cause the reflected light to form an image on a light-receiving surface of imaging element CCD.

Image signals resulted through photoelectric conversion by the imaging element CCD undergo A/D conversion, shading correction and processing such as compression, in image reading controller 14, to be stored in a memory of controller C as image data.

For the aforesaid image data stored in the memory, there is performed proper image processing under the condition set by a user, and output image data are generated.

Each of exposure sections 2Y, 2M, 2C and 2K is composed of a laser light source, a polygon mirror and plural lenses, to generate a laser beam.

Each of the aforesaid exposure sections 2Y, 2M, 2C and 2K conducts scanning exposure for the surface of each of photoconductors 31Y, 31M, 31C and 31K representing each of constituent factors for image forming sections 3Y, 3M, 3C and 3K, corresponding to output information outputted based on the aforesaid output image data sent from controller C.

A latent image is formed on each of photoconductors 31Y, 31M, 31C and 31K through scanning exposure by the laser beam.

Image forming section 3Y is composed of photoconductor 31Y, main charging section 32Y, developing section 33Y, first transfer roller 34Y and of cleaning section 35Y which are arranged on the circumference of the photoconductor 31Y. The same also applies to photoconductors 31M, 31C and 31K.

A latent image on each of photoconductors 31Y, 31M, 31C and 31K is developed by each of corresponding developing sections 33Y, 33M, 33C and 33K, and a toner image is formed on each photoconductor.

The aforesaid toner image formed on each of photoconductors 31Y, 31M, 31C and 31K representing image carriers is transferred successively at a prescribed position on intermediate transfer belt 41 that is an intermediate transfer body by each of first transfer rollers 34Y, 34M, 34C and 34K of intermediate transfer section 4.

Residual toner on the surface of the photoconductor from which a toner image has been transferred is removed by each of cleaning sections 35Y, 35M, 35C and 35K.

On the other hand, the aforesaid toner image transferred onto the aforesaid intermediate transfer belt 41 which has become an image carrier is conveyed from each of sheet feeding trays PG1, PG2 and PG3 of sheet feeding section 8 by the second transfer roller 42, and is transferred onto sheet P representing a transfer material that is fed out after being synchronized by sheet feeding roller 81.

A surface of intermediate transfer belt 41 from which the toner image has been transferred onto sheet P is cleaned by belt cleaning section 43 to be ready for succeeding image transfer.

On the other hand, sheet P that carries toner images is sent to fixing section 5 where the sheet P is pressurized and heated by rotary bodies such as rollers which face each other to rotate or a belt, thus, toner images are fixed on the sheet P.

The sheet P on which the fixing processing by the fixing section 5 has been terminated is guided in terms of its course by sheet conveyance path switching section 6, to be ejected to sheet ejection table 61.

When ejecting sheet P after reversing it inside out, the sheet P is guided downward temporarily by sheet ejection guide 62, to cause sheet ejection reversing roller 63 to nip a trailing edge of the sheet P, then, the sheet is reversed, and is guided by sheet ejection guide 62 to sheet ejection roller 64 to be ejected.

Further, when forming images also on a reverse side of sheet P, the sheet P on which the image fixing on the obverse has been finished is conveyed to reversing and ejecting section 7 located downward by sheet guide member 62, then, re-feeding and reversing roller 71 is caused to nip the trailing edge of the sheet P, and it is reversed by conveying it oppositely to feed out to re-feeding conveyance path 72 for image forming on the reverse side.

Figure 2:
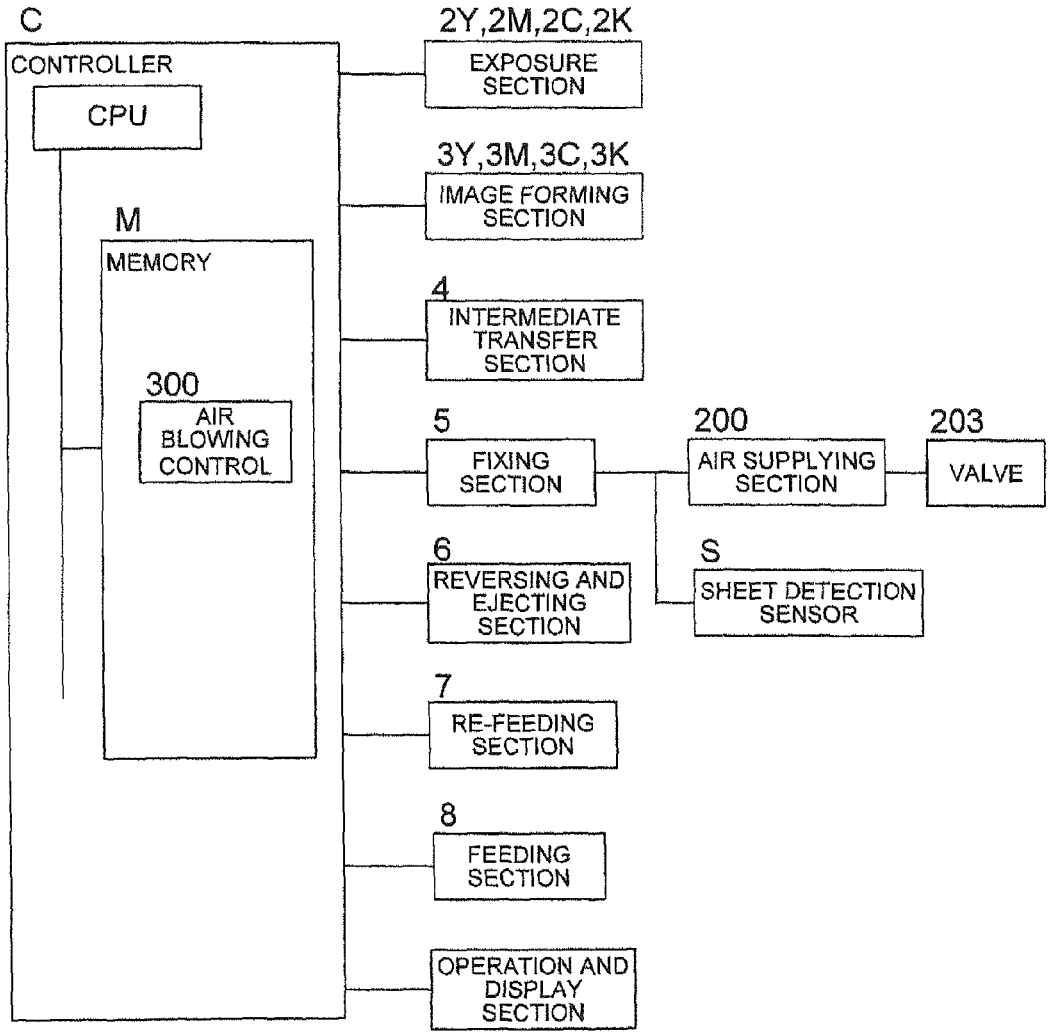
FIG. 2 is a block diagram showing control relationships of an image forming apparatus.

FIG. 2 is a block diagram showing control relationships of image forming apparatus G.

Controller C of image forming apparatus G is a computer system having therein CPU, memory M, an operation unit, I/O port, an interface for communication and a drive circuit.

The control by controller C is carried out by practicing a prescribed program stored in memory M.

Further, the controller C is connected with a network, which makes it possible to exchange information with other information processing equipment.

Meanwhile, in the present diagram, there is omitted a description of a block that has no direct connection with an illustration of the invention.

Figure 3:
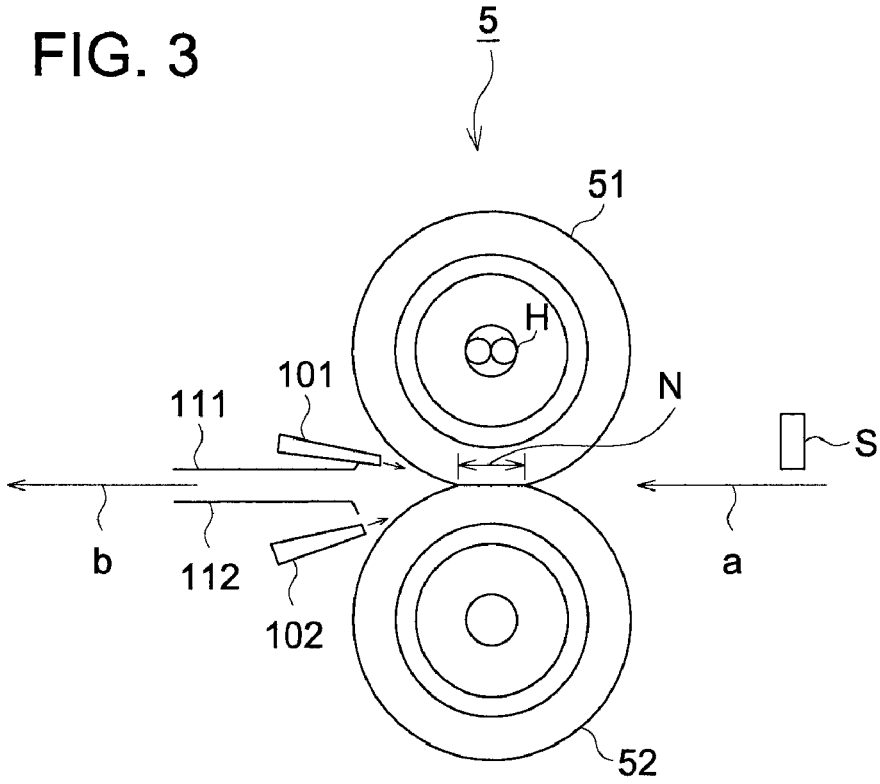
FIG. 3 is a diagram illustrating vicinities of a fixing section.

FIG. 3 is a diagram illustrating vicinities of fixing section 5.

Image forming apparatus G in the present embodiment has two rollers which face each other to rotate, namely, has fixing section 5 that conducts fixing processing by conveying sheet P that is caused by the first rotary body 51 and the second rotary body 52 to travel in the direction of arrow "a", while pressurizing and heating.

Incidentally, the first rotary body 51 is a heating roller that is equipped therein with heater H, wherein an elastic member having prescribed hardness such as silicon rubber is provided on a metal core, while, the second rotary body is a pressurizing member wherein an elastic member having prescribed hardness is provided on a metal core.

Further, the first rotary body 51 and the second rotary body 52 do not always need to be a roller, and both rotary bodies may also be replaced by a belt that is trained about plural rollers or sliding members, as one way. Or, as the other way, a rotary body on one side can be made to be a roller, and a rotary body on the other side can be made to be a belt.

Sheet P pressurized and heated in nip portion N comes out of the nip portion N with a leading edge of the sheet P sticking to the circumferential surface of the first rotary body 51, and the sheet P is separated from the first rotary body by air blown from the first nozzle 101, thus, the sheet P separated from the first rotary body 51 is pushed against a surface of the second rotary body 52.

A leading edge of the sheet P that is advancing along the surface of the second rotary body 52 is separated from the second rotary body 52 by air blown from the second nozzle 102 to travel in the direction shown by arrow "b" while being guided by guide members 111 and 112.

Meanwhile, a leading edge and a trailing edge of the sheet P advancing to fixing section 5 are detected by sheet detection sensor S, and advancing positions for the leading edge and trailing edge of the sheet P are calculated by controller C based on detection signals sent from sheet detection sensor S and on a conveyance speed for sheet P established in advance.

Further, it is also possible to calculate positions for the leading edge and the trailing edge can also be calculated based on sheet-feeding timing signals of sheet-feeding roller 81 and on a conveyance speed for sheet P established in advance.

Figure 4A:
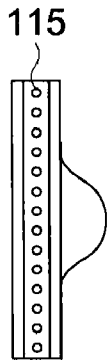
FIG. 4B is a diagram illustrating a nozzle.
Figure 4B:
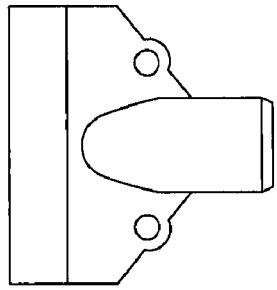

Each of FIG. 4A and FIG. 4B is a diagram for illustrating a nozzle.

Each of the first nozzle 101 and the second nozzle 102 is made by putting plural nozzle units 110 shown in the diagram in the width direction of the sheet to be in a form of plural straight lines. Meanwhile, one nozzle unit that covers a width of a sheet to be passed through is allowed if responsibility is not problematic.

On the tip portion of the nozzle unit 110, small diameter holes 115 are arranged in a form of a straight line as shown in the diagram, and air is blown out of these holes. Incidentally, a diameter of a hole is about 1 mm, and a pitch for holes is about 2.5-3 mm.

Figure 5:
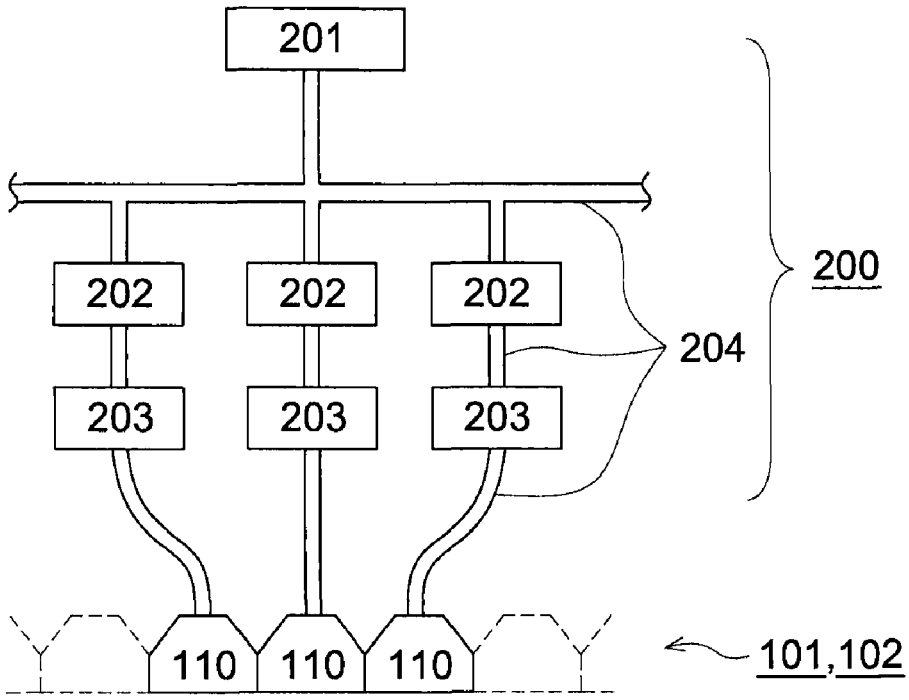
FIG. 5 is a block diagram illustrating an air supplying section.

FIG. 5 is a block diagram illustrating an air supplying section 200.

The air supplying section 200 is a device that sends compressed air to the aforesaid first nozzle 101 and second nozzle 102, and it is composed of air compressor 201, a plurality of regulators 202, a plurality of valves 203 and of air tube 204.

The air compressor 201 is a device to generate compressed air with an air pump, while, the regulator 202 is a device to maintain pressure to be constant for air that is sent to air tube 204, and both of them are devices used widely in general.

On the air tube 204 that sends air to each nozzle, there is provided individually valve 203 for conducting air blowing for a nozzle and stoppage of blowing. Incidentally, opening and closing of the valve 203 is controlled by controller C.

As shown in a diagram, the aforesaid regulator 202 and valve 203 are provided for each nozzle unit, and they are made to be adjustable so that power for blowing out air from each nozzle unit constituting the first nozzle 101 and the second nozzle 102 may be made to be the same, and responding ability for the start and stop of air blowing from the first nozzle and from the second nozzle is enhanced.

Meanwhile, it is also possible to constitute to send air from one regulator 202 and valve 203 for plural nozzle units 110, within a range where neither power nor responding ability is problematic for air blowing.

Figure 6:
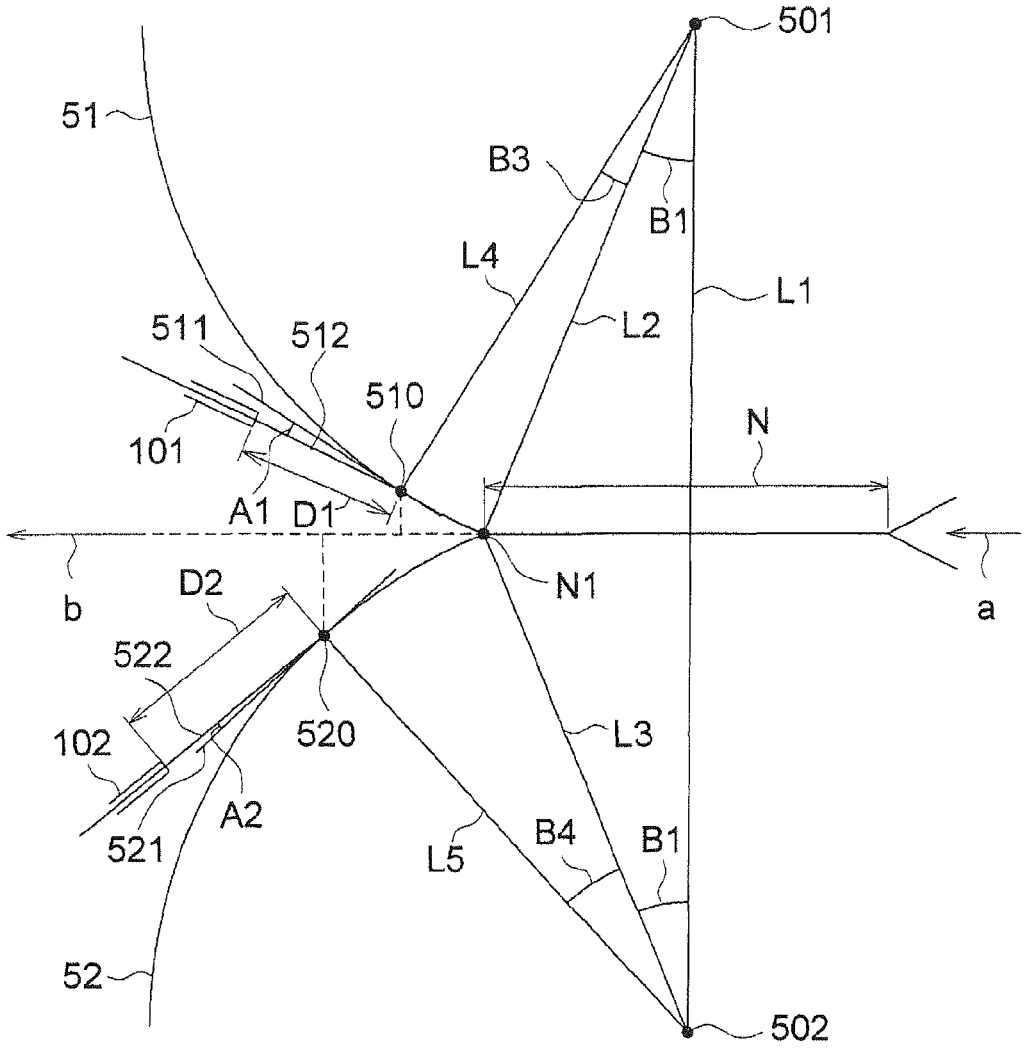
FIG. 6 is a block diagram illustrating an arrangement of rotary bodies which face each other to rotate and of nozzles.

FIG. 6 is a diagram illustrating an arrangement of rotary bodies which face each other to rotate and of nozzles.

The first nozzle 101 is arranged so that air may be blown against the first air blowing position 510 established on the circumferential surface of the first rotary body 51. Further, the second nozzle 102 is arranged so that air may be blown against the second air blowing position 520 established on the circumferential surface of the second rotary body 52.

The outside diameter of each of the first rotary body 51 and the second rotary body 52 in the present embodiment is 80 mm, and a width of a nip portion formed by the two rotary bodies is about 35 mm.

Incidentally, when straight line L1 that connects centers of the aforesaid two rotary bodies is made to be a standard, angle B1 formed by straight lines L2 and L3 each connecting outlet N1 of nip portion N with the center of the rotary body is about 25 degrees.

A position where center line 512 showing the center of an air flow that blows out from the first nozzle 101 intersects the circumferential surface of the first rotary body 51 is called first air blowing position 510 in the present explanation.

The aforesaid first air blowing position 510 is established at the position where angle B3 formed by straight line L4 connecting the aforesaid first air blowing position 510 with center 501 of the first rotary body 51 and by the aforesaid straight line L2 is 10 degrees.

In the same way, a position where center line 522 showing the center of an air flow that blows out from the second nozzle 102 intersects the circumferential surface of the second rotary body 52 is called second air blowing position 520.

The aforesaid second air blowing position 520 is established at the position where angle B4 formed by straight line L5 connecting the aforesaid second air blowing position 520 with center 502 of the second rotary body 52 and by the aforesaid straight line L3 is 20 degrees.

Therefore, the aforesaid second air blowing position 520 is positioned to be at the downstream side of the aforesaid first air blowing position 510 in the direction of travel of sheet P shown by arrow "a" and arrow "b".

By carrying out air blowing against a leading edge portion of sheet P at prescribed timing in the aforesaid position, a flutter of the leading edge portion of the sheet can be restrained, and occurrence of jamming can be prevented.

Meanwhile, when a diameter of the first rotary body 51 is different from that of the second rotary body 52, for example, even when a diameter of the second rotary body 52 is greater than that of the first rotary body 51, the aforesaid second air blowing position 520 needs to be positioned at the downstream side of the aforesaid first air blowing position 510.

In this case, there is sometimes an occasion of an inversion of the relationship in terms of a size between angle B3 formed by straight line L4 connecting the aforesaid first air blowing position 510 with center 501 of the first rotary body 51 and by the aforesaid straight line L2 and angle B4 formed by straight line L5 connecting the aforesaid second air blowing position 520 with center 502 of the second rotary body 52 and by the aforesaid straight line L3.

Meanwhile, angle A1 formed by center line 512 showing the center of an air flow that blows out of the first nozzle 101 and by tangential line 511 on the first air blowing position 510 is about 5 degrees, and angle A2 formed by center line 522 showing the center of an air flow that blows out of the second nozzle 102 and by tangential line 521 on the second air blowing position 520 is also about 5 degrees.

On-off control of timing for air that blows out of a nozzle is carried out when controller C conducts on-off control for valve 203 of air supplying section 200.

Figure 7:
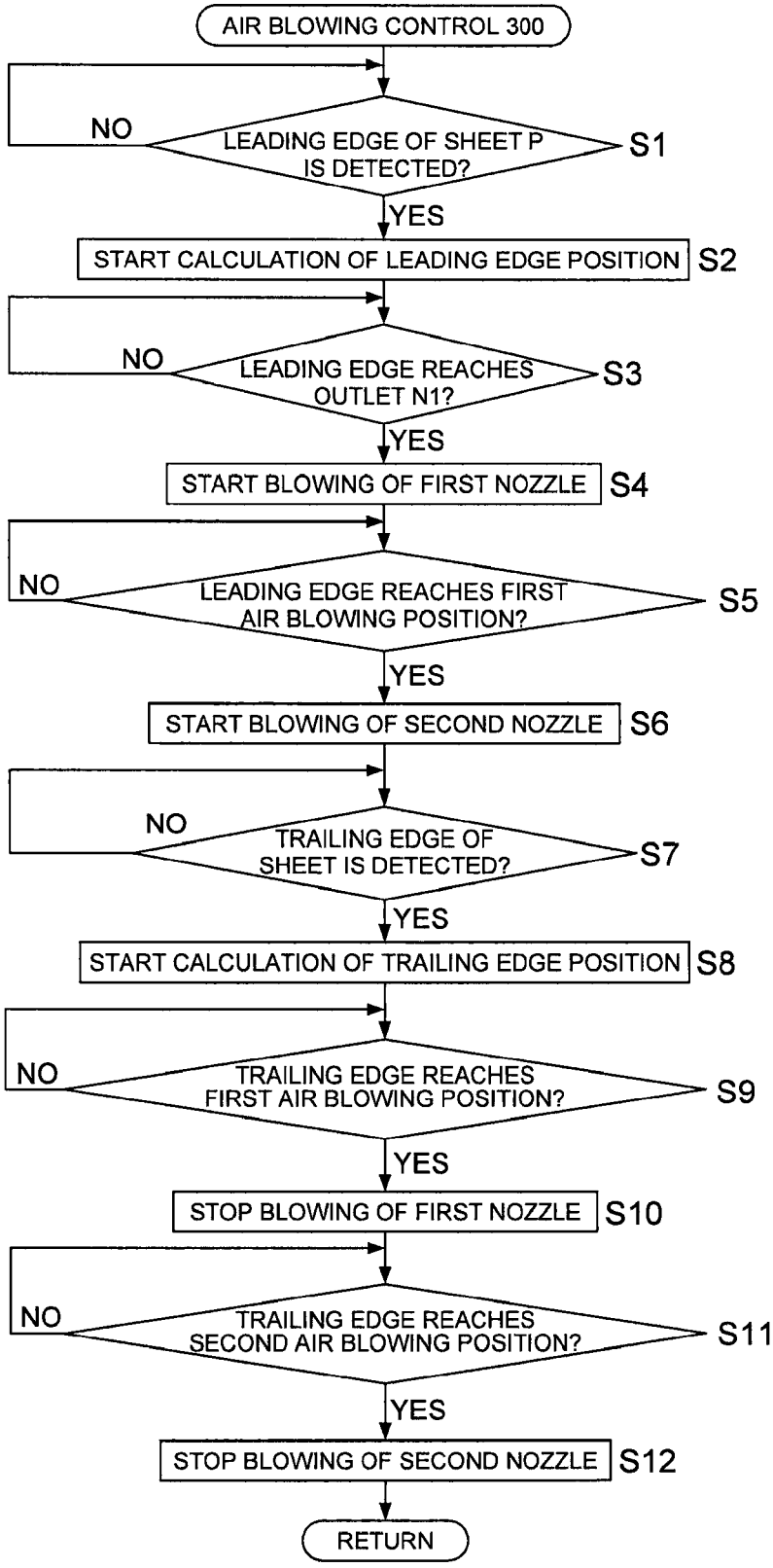
FIG. 7 is a flow chart showing a flow of the control for air blowing.

FIG. 7 is a flow chart showing a flow of air blowing control 300.

When detection signals indicating that a leading edge of sheet P has been detected are received from sheet detection sensor S (step S1: Y), an operation to recognize a position of a leading edge of advancing sheet P based on a conveyance speed for sheet P established in advance is started (step S2).

When a leading edge of sheet P reaches outlet N1 of nip portion N (step S3: Y), valve 203 through which air is blown out of the first nozzle is opened (step S4).

When a leading edge of sheet P reaches the first air blowing position 510 after the sheet P advances (step S5), valve 203 through which air is blown out of the second nozzle is opened (step S6).

When detection signals indicating that a trailing edge of sheet P has been detected are received from sheet detection sensor S, after the sheet P further advances (step S7: Y), an operation to recognize a position of a trailing edge of advancing sheet P based on a conveyance speed for sheet P established in advance is started (step S8).

When a trailing edge of sheet P reaches the first air blowing position 510 (step S9: Y), valve 203 through which air is blown out of the first nozzle is closed (step S10).

Then, when a trailing edge of sheet P reaches the second air blowing position 520 (step S11: Y), valve 203 through which air is blown out of the second nozzle is closed (step S12), to step out of the routine.

Next, results of experiments in the embodiment mentioned above will be explained.

Sheet P used in the experiment was a coated paper for printing having basis weight of 84.9 g/m$^2$, and images having toner coverage of 13.0 g/m$^2$ were formed on the entire surface of this sheet P, and fixing processing was carried out. Meanwhile, experiments to conduct fixing processing without forming toner images were also carried out, without occurrence of new problems.

When a coated paper for printing having basis weight of 127.9 g/m$^2$ was used, sheet P after being subjected to fixing processing was separated from a rotary body even when no air was blown. In this case, even when air was blown, there was no occurrence of problems.

With respect to distance D1 between a tip of the first nozzle 101 and the first air blowing position 510 illustrated in FIG. 6, the shorter the distance is, the more the flow velocity of air blowing out of the nozzle can be lowered. However, if the distance is too short, unevenness of blowing corresponding to a nozzle hole position is caused in the first air blowing position 510.

The unevenness of blowing of this kind causes a problem of irregular separation of sheet P from the first rotary body 51, which results in occurrence of streak type uneven luster on a print surface.

In the present experiment, under the construction of the first nozzle prepared by arranging 8 nozzle units each having 16 holes each having hole diameter of 1.02 mm and hole distance of 3.9 mm, when distance D1 was made to be 15 mm or more, uneven luster was not observed.

Incidentally, even in the case of second nozzle 102 that is composed of a nozzle unit identical to the aforesaid nozzle unit in terms of specifications, distance D2 from a tip of the nozzle to the second air blowing position 520 was made to be the same as the aforesaid distance D1.

Figure 8:
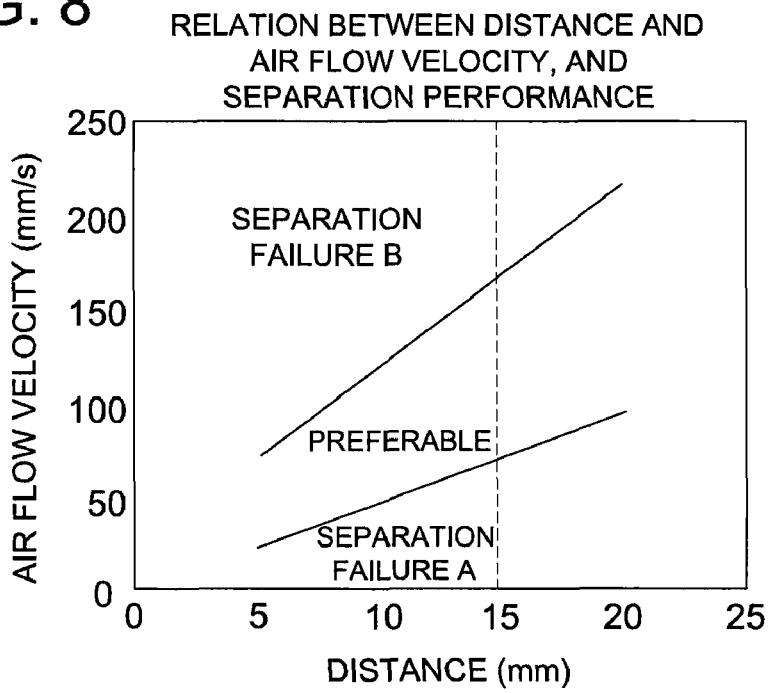
FIG. 8 is a diagram showing relationship for air flow velocity of the air blown from a tip of the first nozzle, a distance from the tip of the first nozzle to the first air blowing position and capacity of separation.

FIG. 8 is a diagram showing relationship for air flow velocity of the air blown from a tip of the first nozzle 101, the distance D1 from the tip of the first nozzle to the first air blowing position 510 and capacity of separation.

Under the conditions that the distance D1 is 15 mm, air flow velocity is 120 m/s and angle B3 is 10 degrees, the leading edge portion of sheet P that has stepped out of nip portion N was separated immediately from the circumferential surface of the first rotary body 51, then, it advanced along the circumferential surface of the second rotary body 52, and showed the most preferable state of separation.

An area that is recognized to be "preferable" in FIG. 8 shows a range of distance D1 and a range of an air flow velocity each showing the most preferable state of separation as stated above. An area of "separation failure A" in FIG. 8 shows a range where an air flow velocity was insufficient and sheet P was not separated from a circumferential surface of the first rotary body 51, and an area of "separation failure B" shows a range where an air flow velocity was too high, on the contrary, and sheet P was pressed against a circumferential surface of the second rotary body 52 to be difficult in terms of separation from the second rotary body 52, although the sheet P is first separated from the first rotary body 51.

When the angle B3 is smaller than 10 degrees, the preferable state of separation is maintained, but when it is larger than 10 degrees, a leading edge of sheet P advances while winding itself round the circumferential surface of the first rotary body 51 depending on a size of the leading edge portion of sheet P, and it is separated from the circumferential surface of the first rotary body 51 before it reaches the established first air blowing position, to advance along the circumferential surface of second rotary body 52 thereafter.

However, it is feared that a phenomenon called separation unevenness wherein a leading edge portion is not separated simultaneously might occur, because the separation of the leading edge portion is separation after the leading edge is wound around the circumferential surface of the first rotary body 51 once, although the leading edge portion of sheet P is separated from the first rotary body as stated above.

In the experiments, even when angle B3 was made to be 40 degrees, a leading edge of sheet P was separated from the first rotary body, and separation unevenness was not caused.

With respect to angle A1 that is formed by center line 512 showing a center of a flow of air that blows out of the first nozzle 101 and by tangential line 511 at the first air blowing position 510 in FIG. 6, when this angle was made to be 5 degrees, the best state of separation was shown.

When the angle A1 is made to be large, there is shown a tendency that a sheet winds itself round the first rotary body 51, and fears for occurrence of separation unevenness are increased. However, in the experiments, there was no occurrence of separation unevenness, even when the angle A1 was made to be 15 degrees in the experiments.

Further, although the higher air flow velocity of the first nozzle 101 improves more efficiency of separation from the first rotary body 51, excessive speed up of the air flow velocity is not advisable, because the flow velocity for air that is blown out of the second nozzle also needs to be increased for separation from the second rotary body 52.

Concerning the separation of sheet P from the second rotary body 52, excellent results were obtained when distance D2 in FIG. 6 was made to be 15 mm and flow velocity of air that is blown out of the second nozzle 102 was made to be 100 m/s.

Meanwhile, when angle B4 in FIG. 6 is made to be smaller than 20 degrees, namely, when the second air blowing position 520 on the second rotary body 52 is moved gradually toward the upstream side in the advancing direction of the sheet, a flutter of the leading edge portion of the sheet becomes to be more violent.

When the angle B4 is made to be smaller than 10 degrees, namely, when the second air blowing position 520 is made to be at the upstream side of the first air blowing position 510, jamming occurs frequently.

Results of the foregoing show that stable separation efficiency can be acquired by making the second air blowing position 520 established on the circumferential surface of the second rotary body 52 to be at the downstream side of the first air blowing position 510 established on the circumferential surface of the first rotary body, in the sheet advancing direction.

Further, when the angle B4 is made to be greater, the pressure of sheet P against the second rotary body 52 caused by air blowing of the first nozzle 101 is lowered, thereby, a position for separation of sheet P and its behavior of separation become unstable, resulting in frequent occurrence of jamming.

Though jamming occurs frequently if the angle B4 exceeds 40 degrees, it is sometimes possible to prevent occurrence of jamming by optimizing a form and a position of a sheet ejection member.

A temperature of the second rotary body 52 is established to be one which does not cause remelting for toner, and the temperature setting of this kind prevents sticking of sheet P to the second rotary body 52 to eliminate unevenness separation, which makes it possible to cause a flow velocity of air that is blown from the second nozzle to be lower than that of air blown from the first nozzle by about 20-30 m/s.

The leading edge portion of sheet P separated from the first rotary body 51 and then from the second rotary body 52 advances while being guided by guide members 111 and 112 exemplified in FIG. 3. However, in this case, if a clearance between a tip portion of the guide member 111 and first nozzle 101 or a clearance between a tip portion of guide member 112 and a second nozzle is too large, the leading edge of sheet P cannot be guided to the prescribed direction, and there is caused dangerousness of occurrence of jamming.

Figure 9:
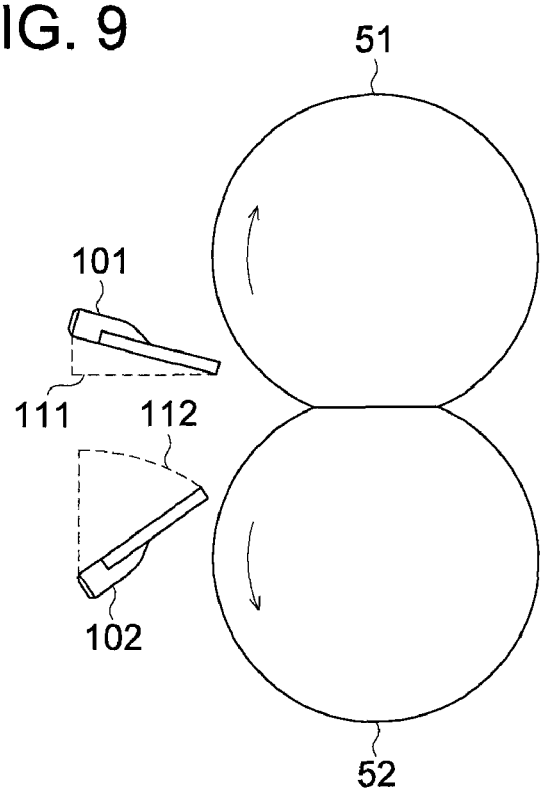
FIG. 9 is a conceptual diagram of a nozzle that is unified with a guide member.

FIG. 9 is a conceptual diagram of a nozzle that is unified with a guide member.

As is shown with dotted lines in the diagram, a side surface of the first nozzle 101 and a side surface of the second nozzle 102 facing sheet P serve as guide surfaces that regulate an advancing direction of sheet P.

Therefore, a clearance between a tip portion of the aforesaid guide members 111 plus 112 and the first nozzle 101 or the second nozzle is eliminated, and a positional relationship between the tip portion of the aforesaid guide members 111 and 112 and the first nozzle 101 or the second nozzle 102 becomes constant.

By providing the first nozzle 101 and the second nozzle 102 having additionally functions of the guide members 111 and 112, conveyance of sheet P that is separated from the first rotary body 51 and the second rotary body 52 is stabilized.

In the image forming apparatus wherein a sheet that carries a toner image is conveyed while the sheet is pressurized and heated in a nip portion formed by the first rotary body and the second rotary body which face each other to rotate, and the toner image is fixed on the sheet, the present embodiment makes it possible to separate the sheet surely from the aforesaid first rotary body and the second rotary body on a non-contact basis.

As a result, occurrence of scratches on a print can be prevented. Further, this effect is exhibited more remarkably in the case of two-sided printing.

What is claimed is:

1. An image forming apparatus for use with at east one sheet comprising:

a first rotary body;

a second rotary body provided to face the first rotary body, wherein the first rotary body and the second rotary body form a nip portion by coming in contact with each other to rotate, at which the sheet bearing a toner image is conveyed while being heated and pressed, thereby fixing the toner image onto the sheet;

a first nozzle which blows air to a first air blowing position established on a circumferential surface of the first rotary body and established on a side of an outlet of the nip portion;

a second nozzle which blows air to a second air blowing position established on a circumferential surface of the second rotary body and established downstream of the first air blowing position in a traveling direction of the sheet;

an air supplying section which supplies air to the first and second nozzles; and a controller which controls a start timing and a stop timing of blowing the air to the first and seconds nozzles by controlling the air supplying section, wherein the controller controls the air supplying section so that an air blowing from the first nozzle is started when a leading edge of the sheet reaches the outlet of the nip portion, and an air blowing from the second nozzle is started when the leading edge of the sheet reaches the first air blowing position.

2. The image forming apparatus of claim 1, wherein each of the first and second nozzles has a plurality of nozzle units which are arranged in a line in a sheet width direction, and the air supplying section has an air valve corresponding to each of the plurality of nozzle units.

3. The image forming apparatus of claim 1, wherein each of the first and second nozzles is integrated with a guide member to regulate the traveling direction of the sheet.

4. The image forming apparatus of claim 1, wherein images are formed on both sides of the sheet.

5. The image forming apparatus of claim 1, wherein the controller controls the air supplying section so that the air blowing from the first nozzle is stopped when a trailing edge of the sheet passes through the first air blowing position, and the air blowing from the second nozzle is stopped when the trailing edge of the sheet passes through the second air blowing position.

* * * * *